United States Patent [19]

Saito et al.

[11] 4,227,882

[45] Oct. 14, 1980

[54] METHOD OF TREATING FIBER OR FIBROUS MATERIAL

[75] Inventors: Toshio Saito, Nagahama; Masao Oguchi, Suita; Akio Kisaichi, Nagahama, all of Japan

[73] Assignee: Kanebo, Ltd., Tokyo, Japan

[21] Appl. No.: 72,861

[22] Filed: Sep. 6, 1979

[30] Foreign Application Priority Data

May 31, 1979 [JP] Japan ..... 54-69223

[51] Int. Cl.[3] ..... D06M 9/00

[52] U.S. Cl. ..... 8/115.5; 8/115.6; 8/128 R; 8/196; 8/DIG. 18; 8/582; 8/602; 8/594

[58] Field of Search ..... 8/DIG. 18, 115.5, 115.6, 8/196, 128 R, 92, 85 R

[56] References Cited

U.S. PATENT DOCUMENTS

| | | | |
|---|---|---|---|
| 2,063,908 | 12/1936 | Dreyfus | 8/92 |
| 3,077,487 | 2/1963 | Ramsey et al. | 8/92 |

OTHER PUBLICATIONS

Zussman, H. W., American Dyestuff Reporter, Jun. 27, 1949, pp. 500–504.

Gard, A. J., American Dyestuff Reporter, Dec. 21, 1953, pp. 867–870.

Trotman, E. R., "Dyeing and Chemical Technology of Textile Fibres", (Griffin, London), 1964, pp. 164–165.

*Primary Examiner*—A. Lionel Clingman

*Attorney, Agent, or Firm*—Blanchard, Flynn, Thiel, Boutell & Tanis

[57] ABSTRACT

Change of color of grafted fiber or fibrous material having active hydrogen can be prevented by treating the fiber or fibrous material with a processing agent consisting mainly of a compound having the following general formula

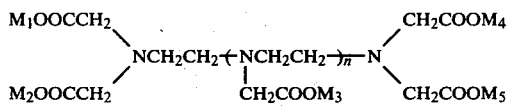

wherein $M_1$–$M_5$ represent a hydrogen atom or alkali metal, and n represents 0 or 1.

14 Claims, No Drawings

METHOD OF TREATING FIBER OR FIBROUS MATERIAL

BACKGROUND OF THE INVENTION (1) Field of the Invention

The present invention relates to a method of treating grafted fiber or fibrous material.

(2) Description of the Prior Art

It is known that a water-soluble vinyl monomer is graft-polymerized to fiber or fibrous material (hereinafter, fiber and fibrous material are merely referred to as fibrous material) having active hydrogen to give permanent sweat absorbing property, hygroscopicity, antistatic property and the like to the fibrous material. However, in the grafted fibrous material, the grafted branched chain changes the properties of the surface of the fibrous material, and when synthetic fiber, such as polyamide fiber or the like, is grafted, slimy feeling peculiar to synthetic fiber decreases or disappears. While, when white fabric is grafted, the surface of the grafted white fabric appears dark due to the irregular reflection of light on the surface. The change of color of fibrous material surface due to the grafting of the fibrous material appears more significantly by the after-treatments, such as fluorescent whitening, dyeing, softening treatment, antistatic treatment and the like, and as the result, the color matching of the above treated fibrous material becomes very difficult.

The inventors have made various investigations in order to prevent the change of color of grafted fibrous material during the above described after-treatments, and found that the change of color can be remarkably decreased by treating the grafted fibrous material with a specifically limited processing agent before the above described after-treatments or with a mixture of the processing agent and other treating agent at the above described after-treatments, and accomplished the present invention.

SUMMARY OF THE INVENTION

It is an object of the present invention to provide a method of preventing the change of color of grafted fibrous material without deteriorating the properties inherent to the fibrous material.

That is, the feature of the present invention is the provision of a method of treating fiber or fibrous material, comprising treating fiber or fibrous material having active hydrogen and graft-polymerized with a water-soluble vinyl monomer, with a processing agent consisting mainly of a compound having the following general formula

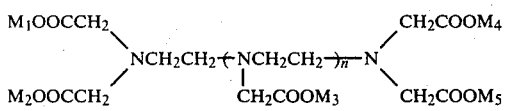

(1)

wherein $M_1$–$M_5$ represent a hydrogen atom or alkali metal, and n represents 0 or 1.

DESCRIPTION OF THE PREFERRED EMBODIMENTS

The fiber having active hydrogen to be used in the present invention includes polyamide fiber (nylon, for example, polycapramide fiber, polyhexamethylene adipamide fiber and the like), silk, wool and the like. Among them, polyamide fiber can be particularly preferable. Because the fiber can be easily graft-polymerized with the water-soluble vinyl monomer, and its hygroscopicity, antistatic property, feeling and other properties are remarkably improved by the graft polymerization.

The fibrous material includes yarn, pad, wad, woven fabric, knitted fabric, nonwoven fabric and the like, which consist at least one of the above described fibers as such or in combination with other fibers. The fibrous material further includes their dyed product, scoured product, bleached product and secondary products, such as sweater, jamper, panty stocking, socks, towel, felt for conveyer belt, writing wick of sign pen and the like.

The water-soluble vinyl monomer to be used in the present invention includes N,N'-methylenebisacrylamide, N,N'-methylenebismethacrylamide, N,N'-methylenebis-α-ethylamide, triacryloylhexahydrotriazine, methoxypolyethylene glycol methacrylate ($CH_2{=}C(CH_3)COO(CH_2CH_2O)_nCH_3$, wherein n=8–14), polyethylene glycol monomethacrylate ($CH_2{=}C(CH_3)COO(CH_2CH_2O)_nH$, wherein n=8–14) and polyethylene glycol dimethacrylate ($CH_2{=}C(CH_3)COO(CH_2CH_2)_nOOC(CH_3)C{=}CH_2$, wherein n=8–14). Among them, N,N'-methylenebisacrylamide is particularly preferable.

The acid to be contained in the treating solution for the graft polymerization includes phosphoric acid, sulfuric acid, hydrochloric acid, acetric acid, formic acid, oxalic acid, tartaric acid, monochloroacetic acid, dichloroacetic acid, trichloroacetic acid and the like.

In the immersion treatment, formic acid, monochloroacetic acid, dichloroacetic acid, trichloroacetic acid, sulfuric acid and hydrochloric acid are preferably used. In the impregnation treatment, formic acid, acetic acid, monochloroacetic acid, sulfuric acid and hydrochloric acid are preferably used. Among them, formic acid is most preferably used, because formic acid hardly corrodes metal and can be easily handled and further proceeds smoothly the graft polymerization.

In the graft polymerization of the present invention, polymerization initiator is used, if necessary. As the polymerization initiator, there are mentioned peroxides, such as ammonium persulfate, potassium persulfate, benzoyl peroxide and the like; cerium salts, such as ammonium ceric sulfate, ammonium ceric nitrate and the like; water-soluble azo compounds, such as sodium 4,4'-azobis-4-cyanovalerate, ammonium 4,4'-azobis-4-cyanovalerate, 2,2'-azobis(2-amidinopropane) hydrochloride and the like.

The treating solution to be used for grafting the fibrous material contains the above described water-soluble vinyl monomer and acid and further the polymerization initiator, if necessary.

The concentration of the water-soluble vinyl monomer in the treating solution should be properly selected depending upon the amount of the vinyl monomer to be adhered to the fibrous material. The water-soluble vinyl monomer is used in an amount of at least 0.01% by weight based on the amount of the fibrous material.

The polymerization initiator is used, if necessary, in an amount of 0.1–10% by weight based on the amount of the water-soluble vinyl monomer. The acid is used in order to adjust the pH of the treating solution. The treating solution is generally used at a pH of not higher than 5.5. The treating solution can be easily prepared by dissolving a water-soluble vinyl monomer in a solvent, such as water, methanol, ethanol or the like, and then adjusting the pH of the solution.

The fibrous material is graft-polymerized with the water-soluble vinyl monomer by the use of the treating solution. In the treatment, immersion, impregnation, spraying and any other methods, which can adhere uniformly the treating solution to the fibrous material, can be adopted irrespective of batch system operation and continuous operation. The treating temperature is about 50°–100° C. and the treating time is about from 10 seconds to 60 minutes. In the immersion treatment, the bath ratio is selected within the range of from 1:50 to 1:100.

The grafted fibrous material is somewhat darker than the untreated fibrous material, and this tendency appears more noticeably by the fluorescent whitening, dyeing, printing and finishing treatment. However, when the grafted fibrous material is bleached by hydrogen peroxide, this tendency can be fairly prevented.

The hydrogen peroxide bleaching can be easily carried out by applying an aqueous solution containing hydrogen peroxide and a stabilizer, such as sodium metaborate or the like, to a grafted fibrous material in the immersion, impregnation, spraying and other proper method, and then heating the above treated fibrous material.

Then, in the present invention, the above described grafted fibrous material is treated with a processing agent consisting mainly of a compound having the following general formula

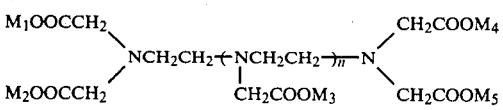

(1)

wherein $M_1$–$M_5$ represent a hydrogen atom or alkali metal, and n represents 0 or 1.

The compound having the general formula (1) includes ethylenediaminetetraacetic acid, monosodium ethylenediaminetetraacetate, disodium ethylenediaminetetraacetate, trisodium ethylenediaminetetraacetate, tetrasodium ethylenediaminetetraacetate, sodium diethylenetriaminepentaacetate and the like. Further, alkali metal salt of ethylenediaminetetraacetic acid or diethylenetriaminepentaacetic acid, which is obtained by substituting a part or all of the hydrogen atoms in the free carboxyl group with an alkali metal, such as lithium, potassium or the like, can be used in the present invention. The above described compounds exhibit more excellent effect in the use in combination with an assistant, such as gluconic acid, citric acid, tartaric acid or the like. Particularly, the use of the processing agent in combination with citric acid is effective.

The processing agent is generally used in the form of a 0.1–10 g/l aqueous solution. The processing agent can be applied to the grafted fibrous material together with a fluorescent whitening agent, dyestuff or pigment at the after-treatments, such as fluorescent whitening, dyeing and printing, or together with a finishing agent at the finishing treatments, such as antistatic treatment and softening treatment. Alternatively, the processing agent can be applied to the grafted fibrous material before the above described after-treatments, or after the after-treatments and before the above described finishing treatments. However, the processing agent is generally applied to the grafted fibrous material at the fluorescent whitening step, dyeing step or printing step by the use of an aqueous solution or dispersion containing both the processing agent and fluorescent whitening agent, dyestuff or pigment.

The treating solution or dispersion containing the above described processing agent is applied to the grafted fibrous material by a commonly known method, such as immersion, impregnation, spraying or the like, which is selected properly depending upon the purpose. When the processing agent is applied to the grafted fibrous material before the above described after-treatments or finishing treatments, the fibrous material is subjected to the after-treatments or finishing treatments without drying.

In general, when a fibrous material having active hydrogen is graft-polymerized with a water-soluble vinyl monomer, sweat-absorbing property, hygroscopicity, antistatic property can be given to the fibrous material, but the whiteness and color of the fibrous material deteriorate. However, according to the present invention, the whiteness and color of a grafted fibrous material can be stabilized while maintaining the improved property of the grafted fibrous material, and further yellowing of grafted fibrous material due to heat at the finishing treatment, and yellowing of the manufactured articles during display and preservation or at the packing can be very effectively prevented. Therefore, the fibrous material treated in the present invention is very useful as a commercial product.

The following examples are given for the purpose of illustration of this invention and are not intended as limitations thereof. In the examples, "%" means % by weight.

Further in the examples, the dielectric resistance was measured in the following manner.

After a disk-like test piece having a diameter of 5 cm is left to stand for 24 hours at 20° C. and 50% RH, the dielectric resistance of the test piece is measured by means of an electrometer (made by Takeda Riken Co.). This measurement is effected with respect to 5 test pieces, and an average value is calculated.

EXAMPLE 1

A nylon tricot was desized, scoured and heat set to obtain a heat-set tricot (30 d/9 fil, weight: 167 g/m$^2$, width: 188 cm). The heat-set nylon tricot was immersed in the following treating solution A in a bath ratio of 1:40.

Treating solution A: An aqueous solution containing 20% by weight, based on the weight of fiber, of N,N'-methylenebisacrylamide and further containing ammonium persulfate in an amount of 1/50 based on the amount of the N,N'-methylenebisacrylamide, and having a pH of 2 adjusted by the use of formic acid.

After the immersion of the nylon tricot in the treating solution A, the treating solution A was heated up to 80° C. in 20 minutes and further kept at 80° C. for 30 minutes while stirring at intervals to effect a graft treatment of the nylon tricot. Then, the nylon tricot was washed with warm water at 60° C. for 20 minutes, followed by cold water washing for 20 minutes. The above grafted nylon tricot is referred to as sample No. $S_1$-1 and the original heat-set nylon tricot is referred to as sample No. $S_0$.

The grafted nylon tricot of sample No. $S_1$-1 was immersed in a treating solution B having a concentration of 2.5 g/l of hydrogen peroxide and 2.5 g/l of sodium metasilicate at 60° C. for 30 minutes to effect a hydrogen peroxide bleaching of the nylon tricot, and then the nylon tricot was washed with hot water and with cold water. The obtained bleached nylon tricot is referred to as sample No. $S_2$-1.

Ecah of the grafted tricot of sample No. $S_1$-1 and the bleached tricot of sample No. $S_2$-1 was immersed in the following treating solution C in a bath ratio of 1:40, and the treating solution C was heated up to 98° C. in 45 minutes and further kept at 98° C. for 30 minutes to effect a fluorescent whitening of the tricot, and then the tricot was washed with water and dried. The above fluorescent-whitened nylon tricots are referred to as sample No. $S_{1F}$-1 and sample No. $S_{2F}$-1, respectively.

Treating solution C: An aqueous solution having a concentration of 2% of Mikephor PAS conc. (a fluorescent dye made by Mitsui Toatsu Chemicals Inc., CI: FB 218), 0.003% of Latyl Violet 2R (a disperse dye made by E. I. DuPont de Nemours & Co., Inc., CI: Violet 18), 0.1% of a mixture of disodium ethylenediaminetetraacetate and disodium citrate in a molar ratio of 1:1, 0.1 g/l of noigen ET 135 (trademark of nonionic surfactant made by Daiichi Kogyo seiyaku Co., Ltd.), 0.4 g/l of Lavelin FML and 0.3 g/l of Malez SM.

In the same manner as described above, each of the grafted nylon tricot of sample No. $S_1$-1 and the bleached tricot of sample No. $S_2$-1 was immersed in the following treating solution D in a bath ratio of 1:40, and the treating solution D was heated up to 98° C. in 60 minutes, and further kept at 98° C. for 45 minutes to dye the nylon tricot and then the dyed nylon tricot was washed with water and dried. The dyed nylon tricots are referred to as sample No. $S_{1D}$-1 and sample No. $S_{2D}$-1, respectively.

Treating solution D: An aqueous solution having a concentration of 0.176% of Diacelliton Fast Yellow G (trademark of dispersed dye made by Mitsubishi Chemical Industries, Ltd., CI: Yellow 3), 0.08% of Celliton Blue Green B (trademark of dispersed dye made by BASF A.G., CI: Blue 7), 0.156% of Cibacet Pink FG (trademark of disperse dye made by Ciba Gaigy Ltd., CI: Red 55), 0.1% of a mixture of disodium ethylenediaminetetraacetate and disodium citrate in a molar ratio of 1:1, 0.1 g/l of Noigen ET 135 and 0.4 g/l of Lavelin FML.

Each of the above treated nylon tricots of sample Nos. $S_1$-1, $S_{1F}$-1, $S_{1D}$-1, $S_{2F}$-1 and $S_{2D}$-1 was padded with the following treating solution E, squeezed by means of a mangle in a squeezing ratio of 100% and then dried at 120° C. for 2 minutes followed by a heat set at 160° C. for 2 minutes to effect a finishing treatment of the tricots. The above finished nylon tricots are referred to as sample Nos. $S_1'$-1, $S_{1F}'$-1, $S_{1D}'$-1, $F_{2F}'$-1 and $F_{2D}'$-1, respectively.

Treating solution E: An aqueous solution having a concentration of 0.5% O.W.S. of Permax 300 (anionic antistatic agent consisting mainly of alkylphosphate made by Yoshimura Oil Chemical Co., Ltd.) and 0.5% O.W.S. of ZXN 350 (polyamide resin series softening agent made by Ipposha Oil Co., Ltd.).

Further, the grafted nylon tricot of sample No. $S_1$-1 was subjected to the same treatment as that for tricot of sample No. $S_{1F}$-1 or $S_{1D}$-1, except that disodium ethylenediaminetetraacetate and disodium citrate were removed from the treating solution C or D. The above treated tricots are referred to as sample No. $S_{0F}$-1 or $S_{0D}$-1, respectively.

The above tread tricot of sample Nos. $S_{0F}$-1 and $S_{0D}$-1 were further subjected to a finishing treatment by the treating solution E to obtain finished tricots of sample Nos. $S_{0F}'$-1 and $S_{0D}'$-1, respectively.

The discoloration of the above treated nylon tricot samples are shown in the following Table 1.

TABLE 1

| Sample No. | Discoloration | Sample No. | Discoloration |
|---|---|---|---|
| $S_{0F}$-1 | quite insignificant | $S_{0F}'$-1 | medial |
| $S_{1F}$-1 | " | $S_{1F}'$-1 | quite insignificant |
| $S_{2F}$-1 | " | $S_{2F}'$-1 | " |
| $S_{0D}$-1 | significant | $S_{0D}'$-1 | noticeable |
| $S_{1D}$-1 | " | $S_{1D}'$-1 | rather insignificant |
| $S_{2D}$-1 | quite insignificant | $S_{2D}'$-1 | quite insignificant |

EXAMPLE 2

The nylon tricot of sample No. $S_1$-1 obtained in Example 1, which was N,N'-methylenebisacrylamide-grafted nylon tricot, was immersed in the following treating solution F in a bath ratio of 1:40, and the treating solution F was heated up to 98° C. in 45 minutes and further kept at 98° C. for 30 minutes to effect a fluorescent whitening of the nylon tricot, and then the nylon tricot was washed with water and dried. Further, a part of the fluorescent-whitened nylon tricot was subjected to a finishing treatment by the treating solution E described in Example 1.

Treating solution F: An aqueous solution having a concentration of 2% of Mikephor PAS conc., 0.003% of Latyl Violet 2R, 0.1 g/l of Noigen ET 135, 0.4 g/l of Lavelin FML, 0.3 g/l of Malez SM and 0.1% of a compound described in the following Table 2.

The discoloration of the above treated nylon tricots is shown in Table 2.

TABLE 2

| Compound added to treating solution F | Fluorescent-whitened tricot | Fluorescent-whitened and finished tricot |
|---|---|---|
| EDTA[1] | quite insignificant | insignificant |
| EDTA . 2Na salt | " | " |
| EDTA . 2Na salt + citric acid . 2Na salt | " | quite insignificant |
| EDTA . 3Na salt | " | insignificant |
| EDTA . 4Na salt | " | " |
| DTPA[2] | insignificant | " |
| EDTA . $NH_4$ salt* | medial | noticeable |
| EDTA . $2NH_4$ | " | " |
| NTA[3]* | " | " |
| DEG[4]* | " | " |

Note:
*Outside the scope of the present invention
[1]Ethylenediaminetetraacetic acid
[2]Diethylenetriaminepentaacetic acid
[3]Nitrilotriacetic acid
[4]Sodium salt of N,N'-di(hydroxyethyl)glycine

EXAMPLE 3

A grafted nylon tricot was produced through the same graft treatment described in Example 1, except that potassium persulfate, ammonium ceric nitrate or 2,2'-azobis(2-amidinopropane) hydrochloride was used in place of ammonium persulfate in the treating solution A of Example 1. The grafted nylon tricot was treated with the treating solution C of Example 1 under the same conditions as described in Example 1 to obtain a fluorescent-whitened nylon tricot. A part of the fluorescent-whitened tricot was further subjected to a finishing treatment with the treating solution E of Example 1.

The following Table 3 shows physical property of the grafted nylon tricot and discoloration of the above treated grafted nylon tricots.

TABLE 3

| Catalyst | Physical property of grafted nylon tricot: Dielectric resistance (Ω) | Physical property of grafted nylon tricot: Feeling | Discoloration: Fluorescent-whitened tricot | Discoloration: Fluorescent-whitened and finished tricot |
|---|---|---|---|---|
| Potassium persulfate | $1.1 \times 10^8$ | 4 | quite insignificant | quite insignificant |
| Ammonium ceric sulfate | $5.4 \times 10^8$ | 4 | quite insignificant | insignificant |
| 2,2'-Azobis(2-amidinopropane) hydrochloride | $3.1 \times 10^9$ | 3-4 | quite insignificant | insignificant |

EXAMPLE 4

A union tricot (nylon: 70 d/18 f, polyurethane: 280 d/172 f, mixing ratio of nylon/polyurethane: 70/30, weight: 200 g/m$^2$, width: 188 cm) was immersed in an aqueous treating solution having a concentration of 0.5% of N,N'-methylenebisacrylamide, 0.5% of potassium persulfate and 0.3% of formic acid, and then the tricot was squeezed in a squeezing ratio of 100% by means of a mangle and subjected to a steaming at 100° C. for 1 hour to effect a graft-treatment of the union tricot. The above treated tricot was washed with warm water kept at 60° C. for 20 minutes and further washed with cold water for 20 minutes. The grafted union tricot was referred to as sample No. $S_1$-4.

The grafted union tricot of sample No. $S_1$-4 was subjected to a fluorescent whitening treatment in the same manner as described in Example 1 by the treating solution C described in Example 1 to obtain a fluorescent-whitened tricot of sample No. $S_{1F}$-4. A part of the tricot of sample No. $S_{1F}$-4 was further subjected to a finishing treatment in the same manner as described in Example 1 by the use of the treating solution E described in Example 1 to obtain a fluorescent-whitened and finished tricot of sample No. $S_{1F}'$-4.

In the same manner as described above, the above grafted union tricot of sample No. $S_1$-4 was dyed or was dyed and finished by the treating solutions D and E described in Example 1 to obtain a dyed tricot of sample No. $S_{1D}$-4 or a dyed and finished tricot of sample No. $S_{1D}'$-4.

Discoloration of the above treated tricot samples is shown in the following Table 4.

TABLE 4

| Sample No. | Discoloration | Sample No. | Discoloration |
|---|---|---|---|
| $S_{1F}$-4 | quite insignificant | $S_{1D}$-4 | quite insignificant |
| $S_{1F}'$-4 | insignificant | $S_{1D}'$-4 | rather insignificant |

What is claimed is:

1. A method of treating fiber or fibrous material, comprising treating fiber or fibrous material having active hydrogen and graft-polymerized with a water-soluble vinyl monomer, with a processing agnt consisting mainly of a compound having the following general formula

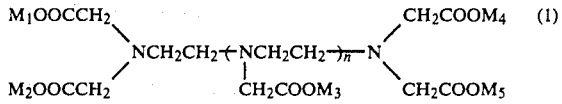

(1)

wherein $M_1$—$M_3$ represent a hydrogen atom or alkali metal, and n represents 0 or 1.

2. A method according to claim 1, wherein said water-soluble vinyl monomer is N,N'-methylenebisacrylamide, N,N'-methylenebismethacrylamide, N,N'-methylenebis-α-ethylamide, triacryloylhexahydrotriazine, methoxypolyethylene glycol methacrylate, polyethylene glycol monomethacrylate or polyethylene glycol dimethacrylate.

3. A method according to claim 1, wherein said processing agent is ethylenediaminetetraacetic acid, monosodium ethylenediaminetetraacetate, disodium ethylenediaminetetraacetate, trisodium ethylenediaminetetraacetate or tetrasodium ethylenediaminetetraacetate.

4. A method according to claim 1, wherein said processing agent is a mixture of a compound having the general formula (1) and an assistant.

5. A method according to claim 4, wherein said assistant is hydroxy-carboxylic acid.

6. A method according to claim 5, wherein said hydroxy-carboxylic acid is citric acid.

7. A method according to claim 1, wherein said graft polymerization is carried out by heating fiber or fibrous material together with a water-soluble vinyl monomer, an acid and a polymerization initiator.

8. A method according to claim 7, wherein said acid is formic acid, monochloroacetic acid, dichloroacetic acid, trichloroacetic acid, sulfuric acid, hydrochloric acid, nitric acid, phosphoric acid, acetic acid or oxalic acid.

9. A method according to claim 7, wherein said polymerization initiator is peroxide, cerium salt or water-soluble azo compound.

10. A method according to claim 9, wherein said peroxide is ammonium persulfate or potassium persulfate.

11. A method according to claim 9, wherein said cerium salt is ammonium ceric sulfate or ammonium ceric nitrate.

12. A method according to claim 9, wherein said water-soluble azo compound is sodium 4,4'-azobis-4-cyanovalerate, ammonium 4,4'-azobis-4-cyanovalerate or 2,2'-azobis(2-aminopropane) hydrochloride.

13. A method according to claim 1, wherein said processing agent is applied to the fiber or fibrous material in the form of a mixture of the processing agent with other treating agent or dye.

14. A method according to claim 1, wherein said fibrous material is hydrogen peroxide-bleached yarn, woven fabric, knitted fabric or nonwoven fabric, which contains fibers produced from polyamide, silk or wool.

* * * * *

UNITED STATES PATENT OFFICE

CERTIFICATE OF CORRECTION

Patent No. 4 227 882 Dated October 14, 1980

Inventor(s) Toshio Saito et al

It is certified that error appears in the above-identified patent and that said Letters Patent are hereby corrected as shown below:

Column 7, line 63; change "agnt" to ---agent---.

Column 8, line 9; change "$M_1$-$M_3$" to ---$M_1$-$M_5$---.

Signed and Sealed this

Sixth Day of January 1981

[SEAL]

*Attest:*

SIDNEY A. DIAMOND

*Attesting Officer* *Commissioner of Patents and Trademarks*